US011099501B2

(12) United States Patent
Kiriyama et al.

(10) Patent No.: US 11,099,501 B2
(45) Date of Patent: Aug. 24, 2021

(54) TONER CARTRIDGE HAVING TONER MEMORY AND ATTACHABLE TO DRUM CARTRIDGE HAVING DRUM MEMORY

(71) Applicant: BROTHER KOGYO KABUSHIKI KAISHA, Nagoya (JP)

(72) Inventors: Tsubasa Kiriyama, Nagoya (JP); Hiroki Mori, Nagoya (JP); Nao Itabashi, Nagoya (JP); Atsushi Fukaya, Toyohashi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/004,358

(22) Filed: Aug. 27, 2020

(65) Prior Publication Data

US 2021/0063911 A1 Mar. 4, 2021

(30) Foreign Application Priority Data

Aug. 30, 2019 (JP) ..... JP2019-158773

(51) Int. Cl.
*G03G 15/08* (2006.01)
*G03G 21/18* (2006.01)
(Continued)

(52) U.S. Cl.
CPC ..... *G03G 15/0863* (2013.01); *G03G 15/0867* (2013.01); *G03G 15/80* (2013.01); *G03G 21/1652* (2013.01); *G03G 21/1885* (2013.01)

(58) Field of Classification Search
CPC ..... G03G 15/0863; G03G 15/0867; G03G 15/80; G03G 21/1652; G03G 21/1676;
(Continued)

(56) References Cited

U.S. PATENT DOCUMENTS 7,424,245 B2 * 9/2008 Burchette ..... G03G 21/1878 399/107
2008/0199204 A1 8/2008 Ishii et al.
(Continued)

FOREIGN PATENT DOCUMENTS

CN 206039150 U 3/2017
JP 2016-6468 A 1/2016
(Continued)

OTHER PUBLICATIONS

International Search Report issued in corresponding International Patent Application No. PCT/JP2020/032086, dated Nov. 2, 2020.
(Continued)

*Primary Examiner* — Sophia S Chen
(74) *Attorney, Agent, or Firm* — Merchant & Gould P.C.

(57) ABSTRACT

A toner cartridge includes a casing, a developing roller, a holder, a toner memory, an electrical contact and a wiring. The holder is positioned at an outer surface of one side in a first direction of the casing. The electric contact surface is positioned at an outer surface of one side in a second direction of the holder. The second direction crosses the electric contact surface. The electrical contact is positioned on an outer surface of another side in the second direction of the holder. The wiring electrically connects the electrical contact and the electric contact surface. The electric contact surface includes a first electric contact surface and a second electric contact surface. The first electric contact surface electrically is connected to the electrical contact through the wiring. The second electric contact surface electrically is connected to the toner memory.

15 Claims, 8 Drawing Sheets

(51) Int. Cl.
*G03G 15/00* (2006.01)
*G03G 21/16* (2006.01)

(58) Field of Classification Search
CPC ..... G03G 21/1878; G03G 21/1885; G03G 2221/163; G03G 2221/1823
See application file for complete search history.

(56) References Cited

U.S. PATENT DOCUMENTS

| | | | |
|---|---|---|---|
| 2018/0314202 | A1 | 11/2018 | Yokoi |
| 2019/0041792 | A1 | 2/2019 | Kishi et al. |
| 2019/0079425 | A1 | 3/2019 | Lin |
| 2019/0171158 | A1 | 6/2019 | Shao et al. |
| 2019/0196394 | A1 | 6/2019 | Yabuki et al. |
| 2019/0391529 | A1 | 12/2019 | Abe et al. |
| 2020/0073286 | A1* | 3/2020 | Takeuchi ..... G03G 15/0863 |
| 2020/0285191 | A1* | 9/2020 | Shimizu ..... G03G 21/181 |
| 2020/0285192 | A1* | 9/2020 | Kawamura ..... G03G 15/0863 |

FOREIGN PATENT DOCUMENTS

| | | | |
|---|---|---|---|
| JP | 2018146829 | A | 9/2018 |
| JP | 2018146830 | A | 9/2018 |
| JP | 2018-173526 | A | 11/2018 |
| JP | 2018189740 | A | 11/2018 |

OTHER PUBLICATIONS

Written Opinion issued in corresponding International Patent Application No. PCT/JP2020/032086, dated Nov. 2, 2020.

* cited by examiner

TONER CARTRIDGE HAVING TONER MEMORY AND ATTACHABLE TO DRUM CARTRIDGE HAVING DRUM MEMORY

CROSS REFERENCE TO RELATED APPLICATION

This application claims priority from Japanese Patent Application No. 2019-158773 filed Aug. 30, 2019. The entire content of the priority application is incorporated herein by reference.

TECHNICAL FIELD

The present disclosure relates to a toner cartridge.

BACKGROUND

There has been known an electro-photographic type image forming apparatus such as a laser printer and an LED printer. Prior art discloses an image forming apparatus including a process cartridge including a toner cartridge and a drum cartridge. Prior art also discloses the toner cartridge including a toner memory such as an IC chip.

SUMMARY

Improvement on product value of an image forming apparatus is expected by utilization of a memory such as an IC chip mounted on a consumable goods. To this effect, recently, mounting a drum memory on the drum cartridge is demanded as well as mounting a toner memory on the toner cartridge. However, the image forming apparatus is difficult to have respective reading mechanisms for reading data from the toner memory and the drum memory due to conflicting demand of reduction in size of the image forming apparatus and limitation of a space for layout of the reading mechanisms.

In view of the foregoing, it is an object of the disclosure to provide a technology capable of providing space saved reading mechanisms for the toner memory and the drum memory in an image forming apparatus employing the toner cartridge and the drum cartridge.

In order to attain the above and other objects, according to one aspect, the disclosure provides a toner cartridge including a casing, a developing roller, a holder, a toner memory, an electrical contact and a wiring. The casing is configured to accommodate toner therein. The developing roller is rotatable about a developing axis extending in a first direction. The holder is positioned at an outer surface of one side in the first direction of the casing. The toner memory stores therein information related to the toner cartridge. The electric contact surface is positioned at an outer surface of one side in a second direction of the holder. The second direction crosses the electric contact surface. The electrical contact is positioned at an outer surface of another side in the second direction of the holder. The wiring electrically connects the electrical contact and the electric contact surface. The electric contact surface includes a first electric contact surface and a second electric contact surface. The first electric contact surface electrically is connected to the electrical contact through the wiring. The second electric contact surface electrically is connected to the toner memory.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, one embodiment of the present disclosure will be described with reference to the accompanying drawings.

In the following description, an extending direction of a rotation axis (developing axis) of a developing roller will be referred to as a "first direction". A direction crossing an electric contact surface 32A of a toner memory 32 will be referred to as a "second direction". Preferably, the second direction is perpendicular to the electric contact surface 32A. Further, a direction crossing the first and second directions referred to as a "third direction".

<1. Outline of Image Forming Apparatus>

Figure 1:
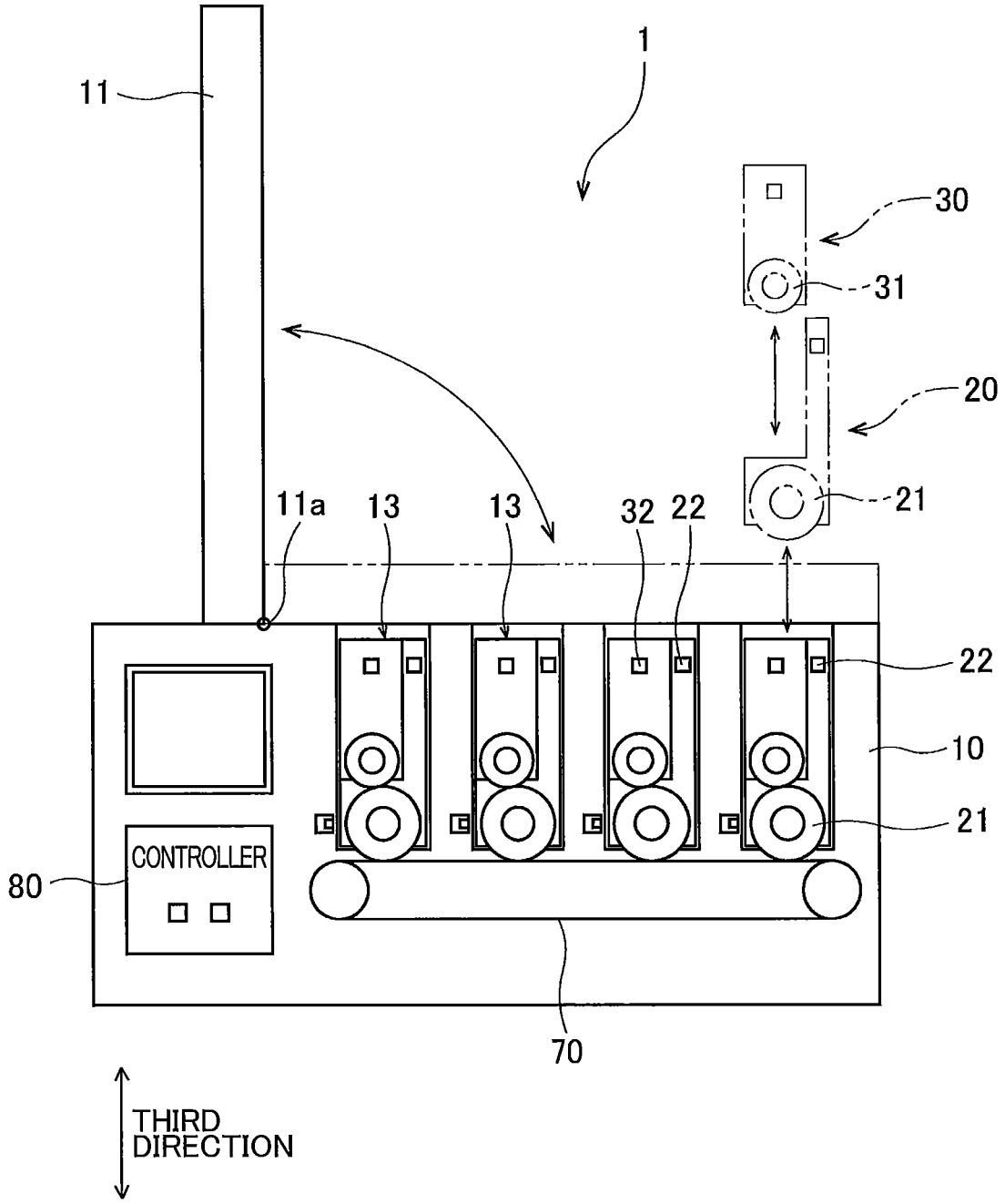
FIG. 1 is a schematic view of an image forming apparatus.

FIG. 1 is a schematic view of an image forming apparatus 1. The image forming apparatus 1 is an electro-photographic type printer such as an LED printer. The image forming apparatus 1 includes a housing 10, a cover 11, four drum cartridges 20, four toner cartridges 30, four light source units (not illustrated), a transfer belt 70, a controller 80, and a main body-electrical contact 90 (FIG. 2).

The housing 10 has a rectangular box shape. The housing accommodates therein the four drum cartridges 20, the four toner cartridges 30, the transfer belt 70, the controller 80, and the main body-electrical contact 90. The housing 10 includes four cartridge holding portions 13. Each cartridge holding portion 13 has an opening.

The cover 11 is pivotally movable about a pivot axis 11*a* extending in the first direction between an open position as indicated by a solid line in FIG. 1 and a closed position as indicated by a two dotted chain line in FIG. 1. Four openings of the four cartridge holding portions 13 are opened when the cover 11 is at the open position. The four openings are closed when the cover 11 is at the closed position.

Figure 2:
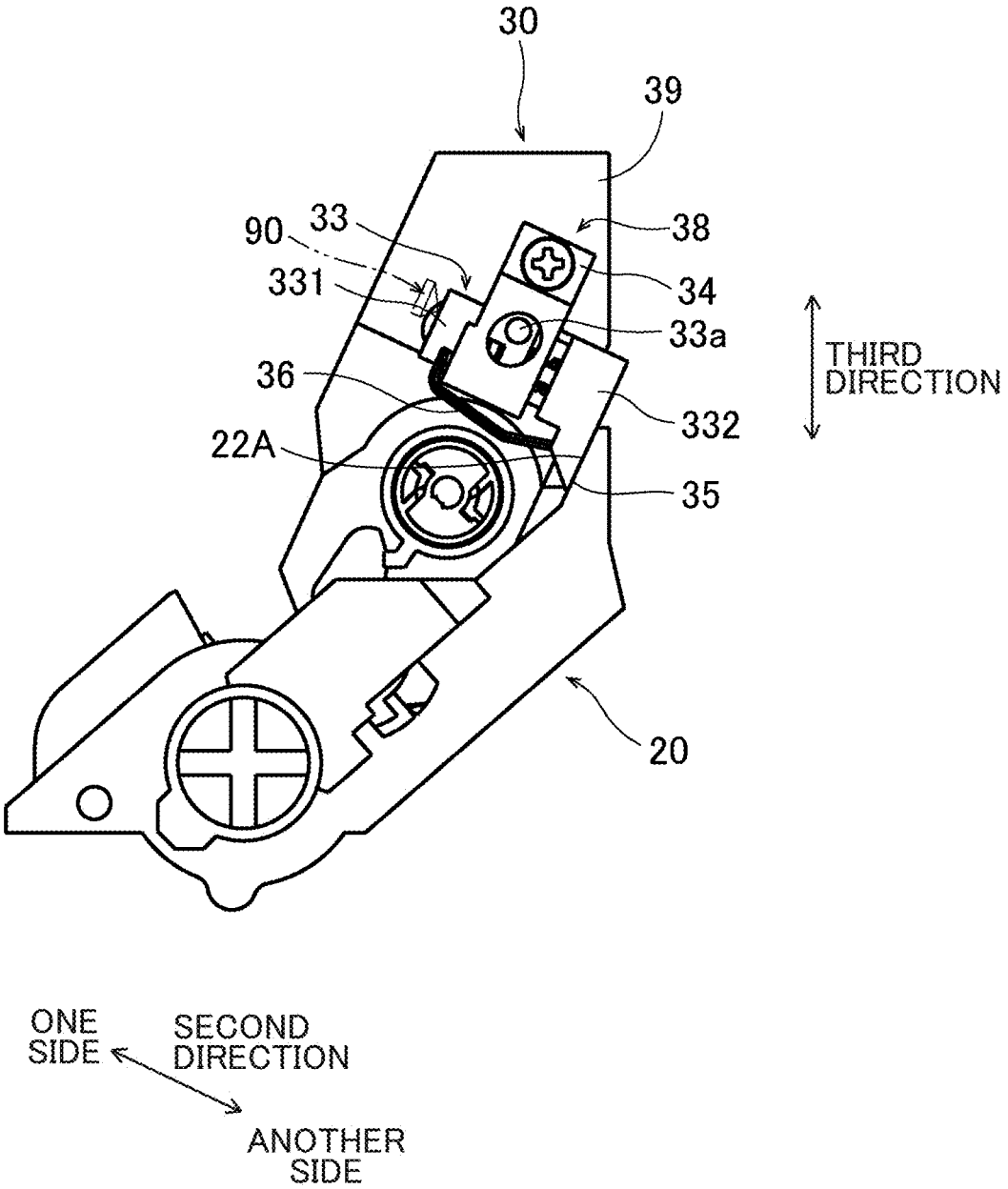
FIG. 2 is a view of a drum cartridge to which a toner cartridge according to one embodiment is attached as viewed from one side in a first direction.
Figure 3:
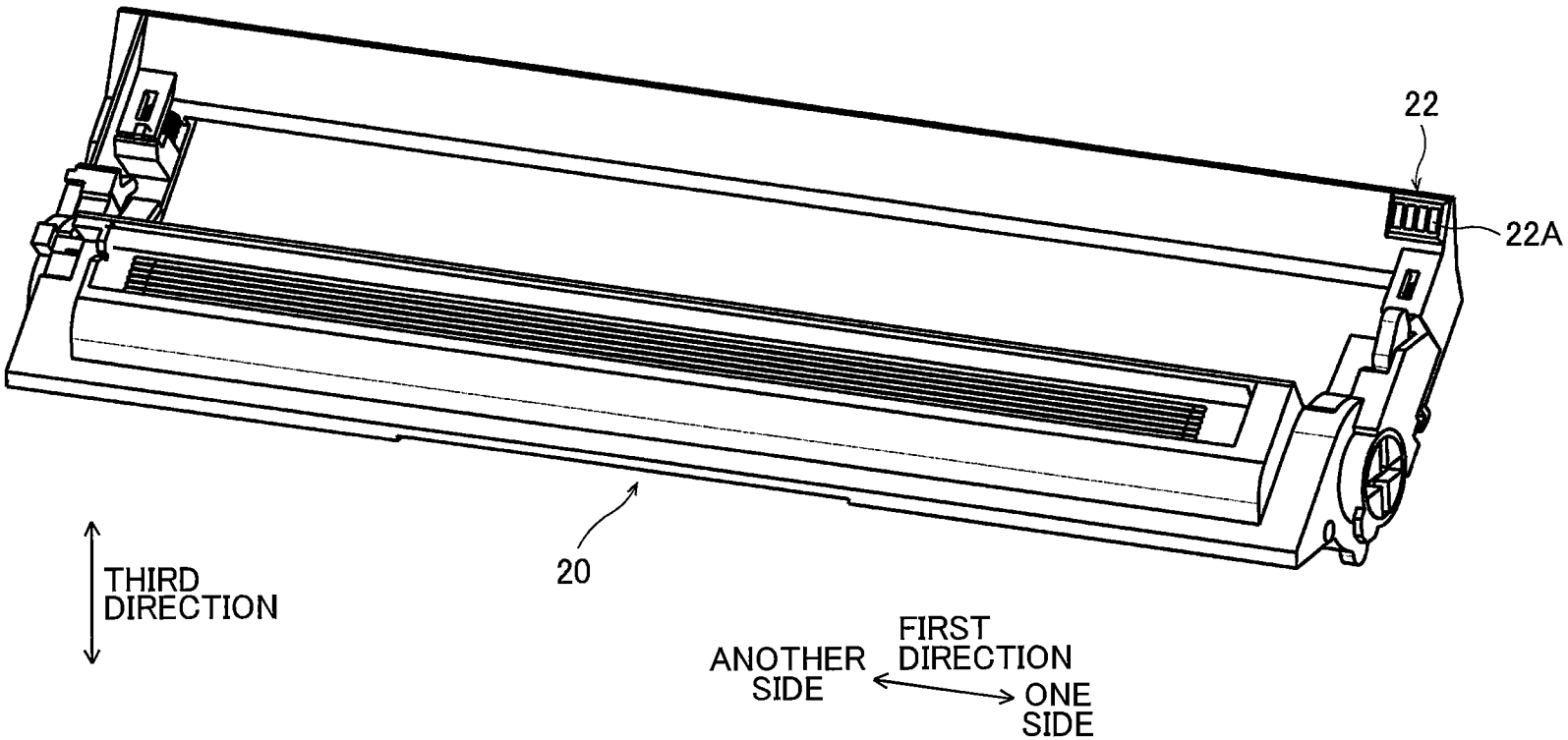
FIG. 3 is a perspective view of the drum cartridge.

FIG. 2 is a view of the drum cartridge 20 to which the toner cartridge 30 is attached as viewed from one side in the first direction. FIG. 3 is a perspective view of the drum cartridge 20. The drum cartridge 20 to which the toner cartridge 30 is attached is attachable to and detachable from the cartridge holding portion 13. In other words, a process cartridge where the toner cartridge 30 is attached to the drum cartridge 20 is attachable to and detachable from the cartridge holding portion 13.

As illustrated in FIG. 1, the drum cartridge 20 includes a photosensitive drum 21. The photosensitive drum 21 is a hollow cylindrical member extending in the first direction. The photosensitive drum 21 is rotatable about a drum axis extending in the first direction. The photosensitive drum 21 has an outer peripheral surface made from a photosensitive material. Further, as illustrated in FIG. 3, the drum cartridge 20 includes a drum memory 22. At least one of data reading and data writing is attainable from and in the drum memory 22. A flash ROM or an EEPROM is an example of the drum memory 22.

The drum memory 22 is a storage medium in which information related to the photosensitive drum 21 of the drum cartridge 20 is storable. Specifically, at least one of information related to identification of the photosensitive drum 21 and information related to service life of the photosensitive drum 21 is an example of the information. Serial number for identification of the drum cartridge 20 is an example of the information related to identification. Further, at least one of cumulative rotation number of the photosensitive drum 21, and cumulative number of printed sheets using the photosensitive drum 21 is an example of the information related to service life. Incidentally, as to the drum cartridge 20 specified by the drum identification information, the cumulative rotation number of the photosensitive drum 21 is calculated by increment or decrement of number of rotation each time printing operation (print job) is performed. Further, as to the drum cartridge 20 specified by the drum identification information, the cumulative number of printed sheets is calculated by increment or decrement of number of printed sheets each time printing operation (print job) is performed.

Further, the drum memory 22 may also store information related to matching model to which the drum cartridge 20 is installable, information related to specification of the drum cartridge 20, information related to newness of the drum cartridge 20, information related to genuineness of the drum cartridge 20, and information related to error history as to the drum cartridge 20.

Figure 4:
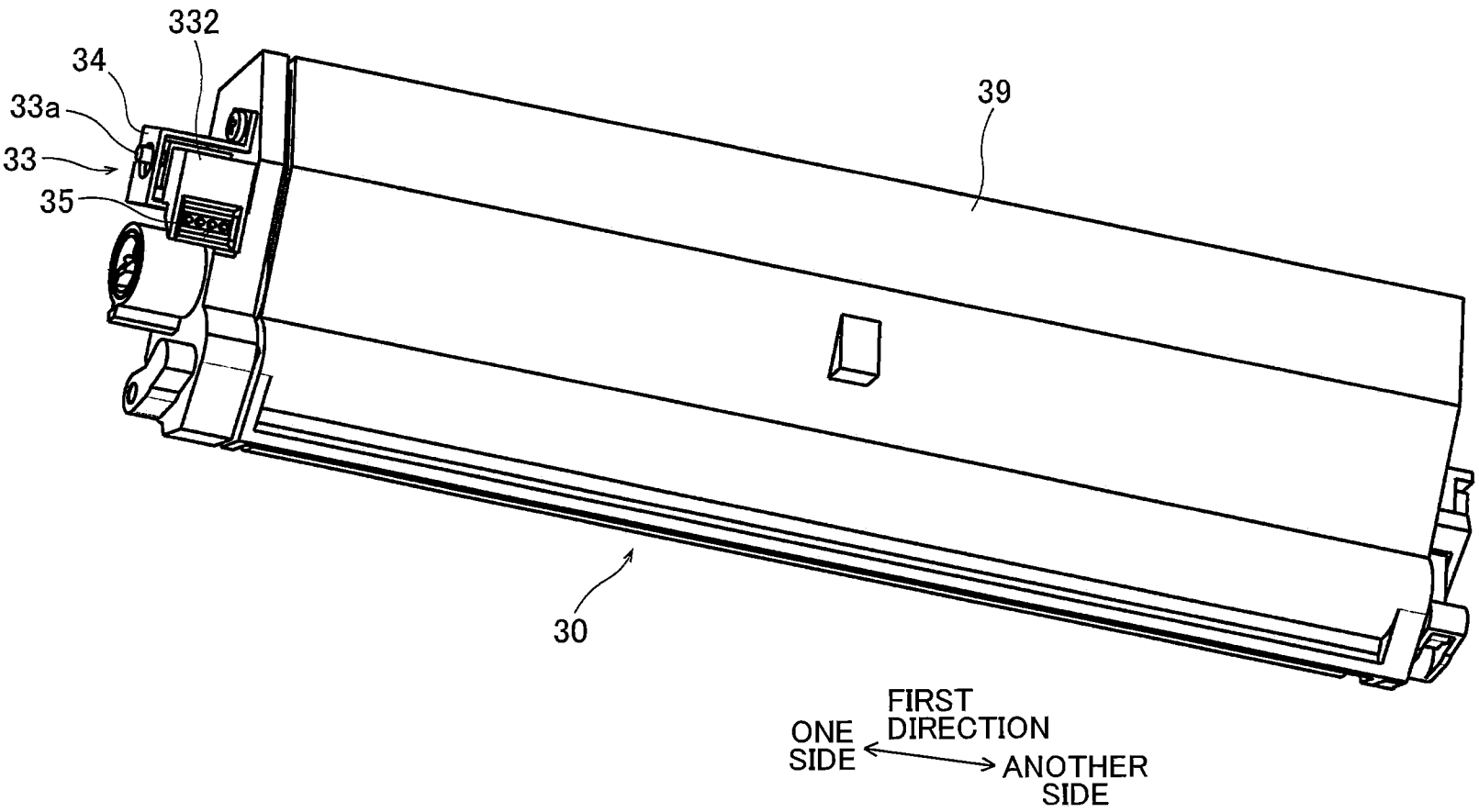
FIG. 4 is perspective view of the toner cartridge according to the embodiment.
Figure 5:
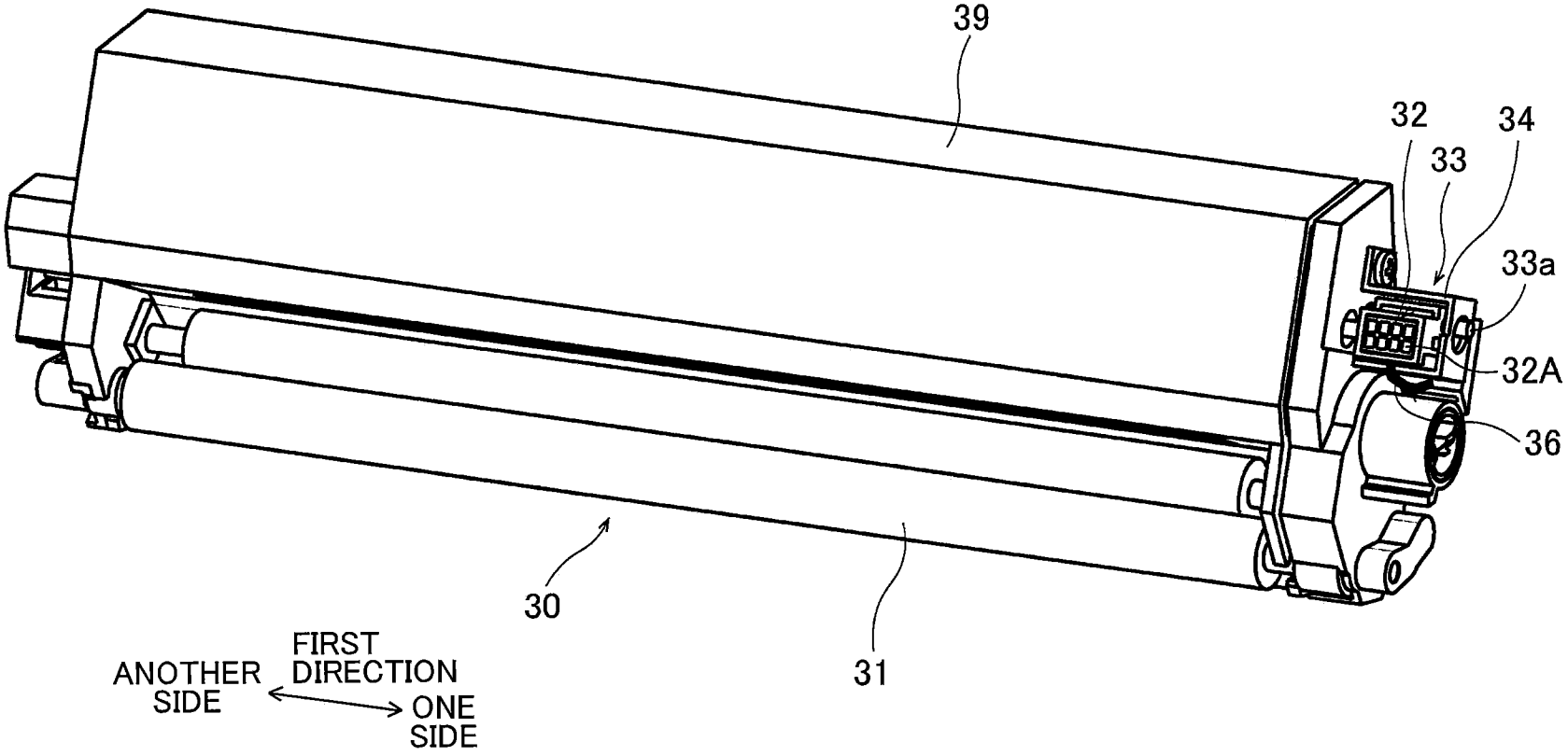
FIG. 5 is another perspective view of the toner cartridge according to the embodiment as viewed in a direction different from the viewing direction in FIG. 4.
Figure 6:
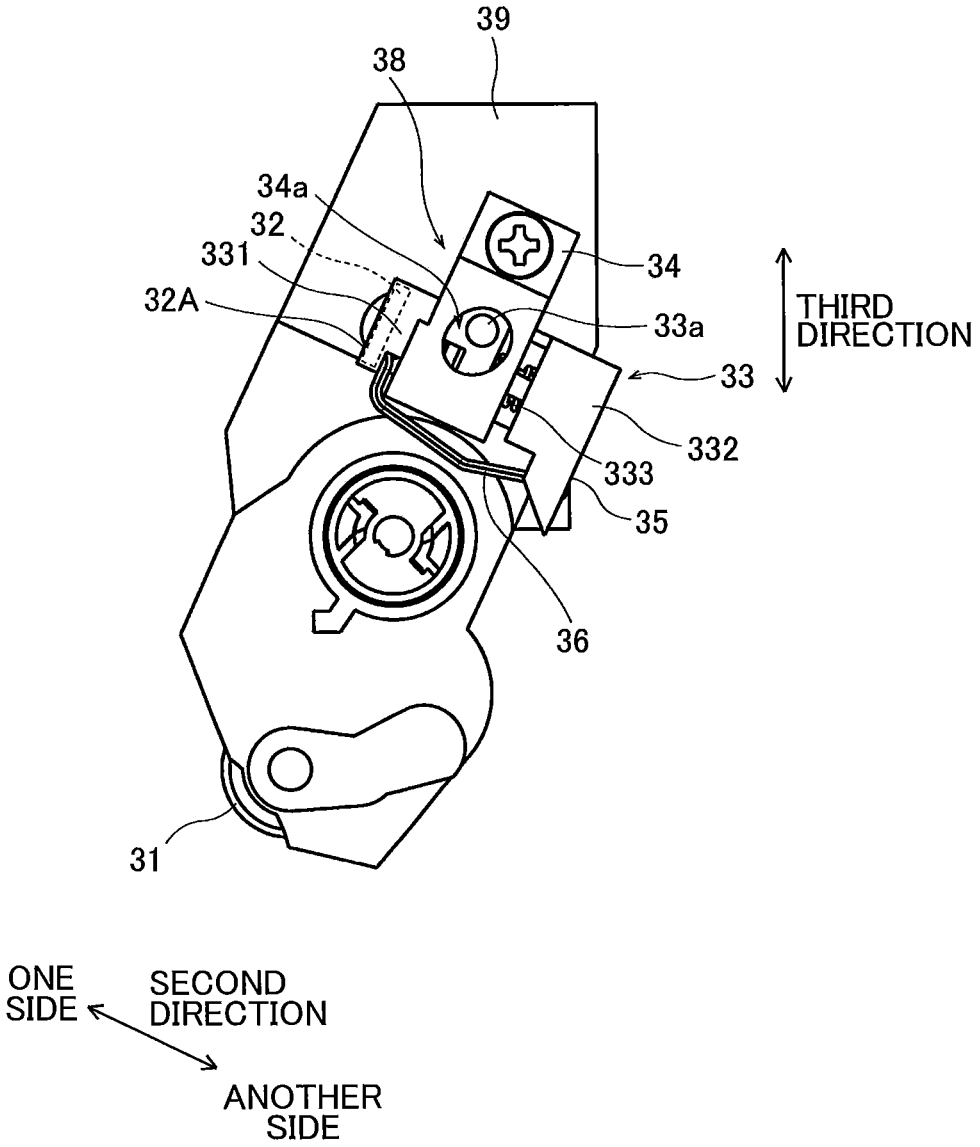
FIG. 6 is a view of the toner cartridge according to the embodiment as viewed from one side in the first direction.

FIGS. 4 and 5 are perspective view of the toner cartridge 30. FIG. 6 is a view of the toner cartridge 30 as viewed from one side in the first direction. The toner cartridge 30 includes a casing 39 in which developing agent, for example, toner is accommodatable. Four toner cartridges 30 accommodate therein developing agents of different colors (for example, cyan, magenta, yellow, and black). The toner cartridge 30 includes the developing roller 31. The developing roller 31 is a cylindrical member extending in the first direction. The developing roller 31 is rotatable about the developing axis extending in the first direction.

Upon attachment of the toner cartridge 30 to the drum cartridge 20, an outer peripheral surface of the developing roller 31 contacts an outer peripheral surface of the developing roller 31. The toner cartridge 30 further includes the toner memory 32. The toner memory 32 is positioned at an outer surface of one side in the first direction of the toner cartridge 30. At least one of data reading and data writing is attainable from and in the toner memory 32. A flash ROM or an EEPROM is an example of the toner memory 32.

The toner memory 32 is configured to store information related to the toner cartridge 30. Specifically, at least one of information related to toner identification and information related to service life of toner is an example of the information. Serial number for identification of the toner cartridge 30 is an example of the information related to identification. Further, at least one of cumulative rotation number of the developing roller 31, cumulative number of printed sheets using the developing roller 31, and cumulative number of dots using the developing roller 31 is an example of the information related to service life. Incidentally, as to the toner cartridge 30 specified by the toner identification information, the cumulative rotation number of the developing roller 31 is calculated by increment or decrement of number of rotation each time printing operation (print job) is performed. Further, as to the toner cartridge 30 specified by the toner identification information, the cumulative number of printed sheets is calculated by increment or decrement of number of printed sheets each time printing operation (print job) is performed. Further, as to the toner cartridge 30 specified by the toner identification information, the cumulative number of dots is calculated by increment or decrement of number of dots each time printing operation (print job) is performed.

Further, the toner memory 32 may also store information related to matching model to which the toner cartridge 30 is installable, information related to specification of the toner cartridge 30, information related to newness of the toner cartridge 30, information related to genuineness of the toner cartridge 30, and information related to error history as to the toner cartridge 30.

The drum cartridge 20 to which the toner cartridge 30 is attached is attached to the housing 10 while the cover 11 is at the open position. At this time, the drum cartridge 20 to which the toner cartridge 30 is attached is inserted into the cartridge holding portion 13 through the opening.

Four light source units are attached to an inner surface of the cover 11. In a state of attachment of the drum cartridge 20 to the housing 10, each light source unit faces each outer peripheral surface of each photosensitive drum 21 when the cover 11 is at the closed position. Further, each light source unit includes a plurality of light sources arrayed with each other in the first direction. The light source is configured to irradiate light to the outer peripheral surface of the photosensitive drum 21. An LED (light emitting diode) is an example of the light source.

The light source unit is electrically connected to the controller 80. The controller 80 is configured to permit the plurality of light sources to emit light in response to image data input in the controller 80. Hence, the light source irradiates light to the outer peripheral surface of the photosensitive drum 21. As a result, the photosensitive material of the outer peripheral surface is exposed to light in response to the image data.

The transfer belt 70 is an endless belt contactable with the photosensitive drum 21. The outer peripheral surface of the photosensitive drum 21 is contactable with the outer peripheral surface of the transfer belt 70. During printing process, the printing sheet is conveyed to a portion between the transfer belt 70 and the photosensitive drum 21. The transfer belt 70 is looped over a drive roller and a driven roller. The drive roller is configured to drive the transfer belt 70. The controller 80 is configured to permit the drive roller to rotate. The driven roller is rotated in accordance with a circular movement of the transfer belt 70 driven by the drive roller.

The controller 80 includes a processor such as a CPU, and a main memory. At least one of data reading and data writing from and to the main memory can be performed. A flash ROM or EEPROM is available as the main memory, for example. The main memory may be mounted on a board of the controller 80. Alternatively, the main memory may be positioned outside of the board of the controller 80.

The main memory stores therein a computer program for controlling operation of the image forming apparatus 1. The processor is configured to perform various processing in accordance with the computer program stored in the main memory. Hence, the image forming apparatus 1 can perform printing process and other process subordinate the printing process.

When attaching the drum cartridge 20 to which the toner cartridge 30 is attached to the cartridge holding portion 13 of the housing 10, the toner memory 32 and the drum memory 22 are electrically contacted with the controller 80. Hence, the controller 80 can perform at least one of data reading and data writing from and to the toner memory 32 and can perform at least one of data reading and data writing from and to drum memory 22.

<2. Structure of Electrical Connection>

Electrical connection of the toner memory 32 and the drum memory 22 to the controller 80 will be described in detail. The toner cartridge 30 includes an IC chip assembly 38 as a structure for electrical connection. Further, the drum cartridge 20 includes the drum memory 22 (FIG. 3) as a structure for electrical connection. Further, the image forming apparatus 1 includes a main body where a main body-electrical contact 90 (FIG. 2) is positioned as a structure for electrical connection.

<2-1 Structure for Electrical Connection in Drum Cartridge>

As illustrated in FIG. 3, the drum memory 22 is positioned at an outer surface of one side in the second direction of the drum cartridge 20. The drum memory 22 is positioned away from the photosensitive drum 21 in the third direction.

The drum memory 22 includes a plurality of (four in the embodiment) drum-electric contact surfaces 22A positioned at an outer surface of one side in the second direction of the drum memory 22. That is, the plurality of drum-electric contact surfaces 22A is positioned at an outer surface of one side in the second direction of the drum cartridge 20. The drum-electric contact surface 22A extends in a direction approximately perpendicular to the second direction. The drum-electric contact surface 22A is made from electrically conductive metal. Each drum-electric contact surface 22A extends in a direction crossing the first direction and the second direction. The drum-electric contact surface 22A is contactable with an electrical contact 35 of the drum cartridge 20 described later.

<2-2 Structure for Electrical Connection in Main Body>

The main body-electrical contact 90 is positioned at an inner surface of the housing 10. The main body-electrical contact 90 includes a plurality of (eight in the present embodiment) metallic protrusions protruding inward away from the inner surface of the housing 10 in the second direction. The main body-electrical contact 90 is contactable with the electric contact surface 32A of the toner memory 32 described later.

<2-3 Structure for Electrical Connection in Toner Cartridge>

Figure 7:
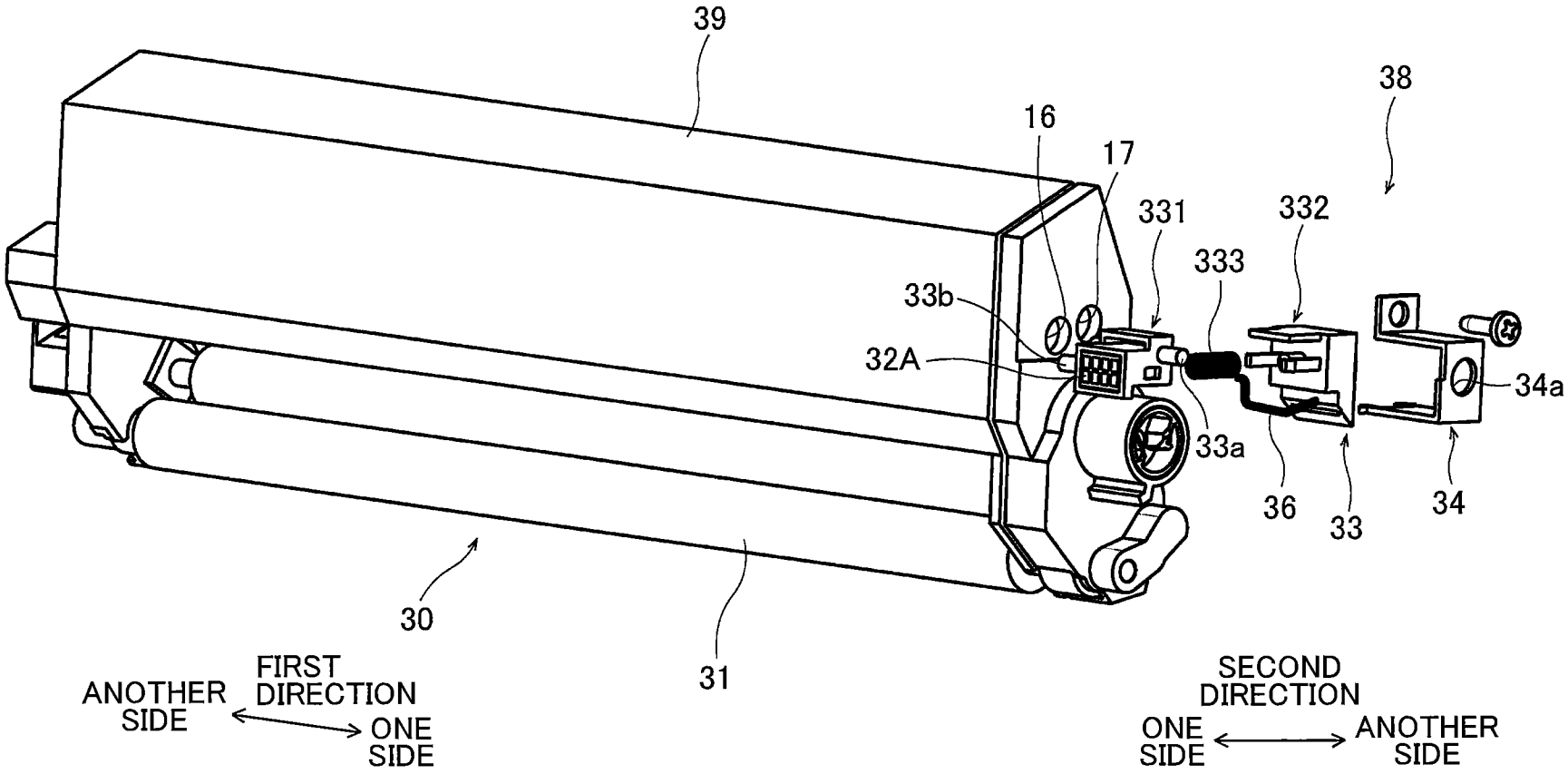
FIG. 7 is a perspective view of the toner cartridge according to the embodiment including an exploded perspective view of an IC chip assembly.
Figure 8:
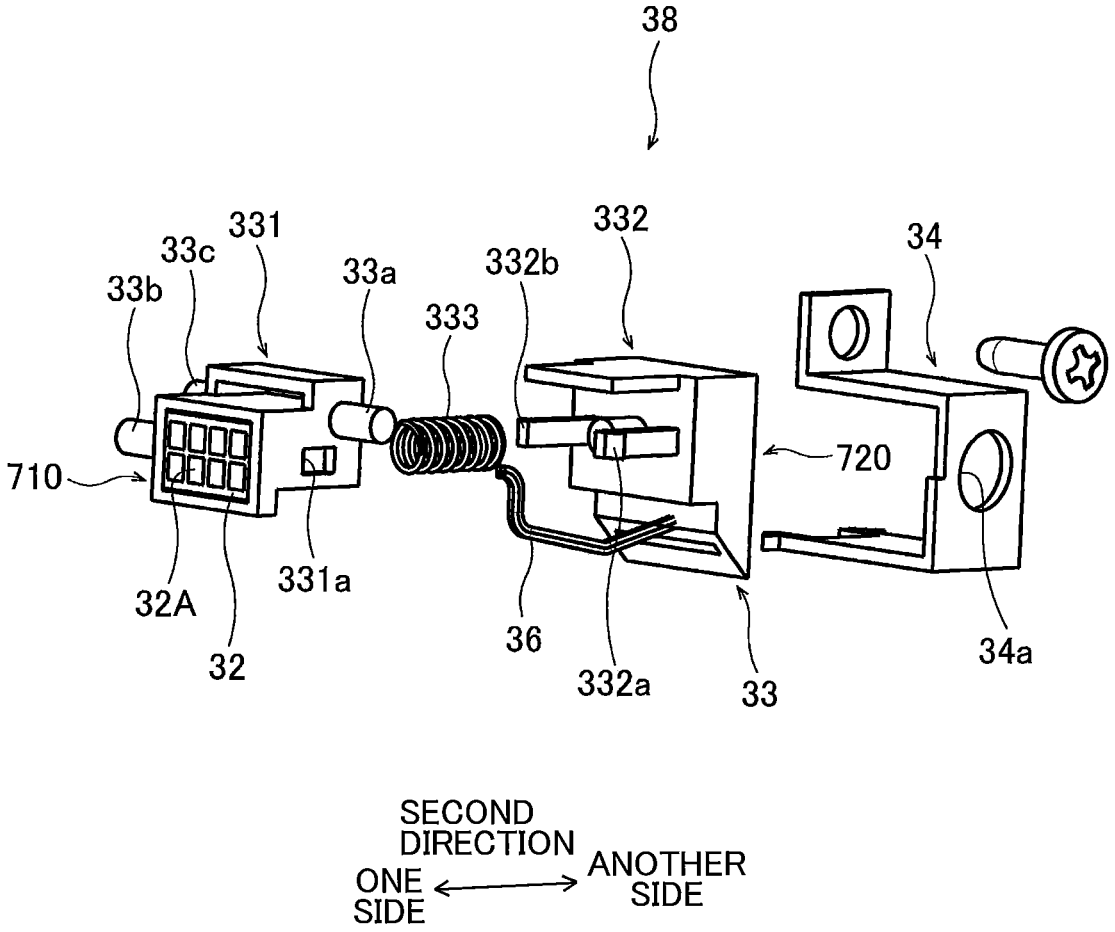
FIG. 8 is an exploded perspective view of the IC chip assembly of the toner cartridge according to the embodiment.

FIG. 7 is a perspective view of the toner cartridge 30 including an exploded perspective view of the IC chip assembly 38. FIG. 8 is an exploded perspective view of the IC chip assembly 38. As illustrated in FIGS. 7 and 8, the IC chip assembly 38 includes the toner memory 32, a holder 33, a holder cover 34, the electrical contact 35, and a wiring 36.

The holder 33 is configured to hold the toner memory 32. The toner memory 32 is fixed to an outer surface of one side in the second direction of the holder 33. A plurality of (eight in the present embodiment) electric contact surfaces 32A is positioned at the outer surface of one side in the second direction of the holder 33. That is, the toner memory 32 has the plurality of electrical contact surfaces 32. The electric contact surface 32A is made from electrically conductive metal. Each electric contact surface 32A extends in a direction crossing the first direction and the second direction.

The eight electric contact surfaces 32A are grouped into four first electric contact surfaces and four second electric contact surfaces. The four first electric contact surfaces are electrically connected to the electrical contact 35 through the wiring 36. The four second electric contact surfaces are electrically connected to the toner memory 32. Upon attachment of the toner cartridge 30 to the cartridge holding portion 13, the main body-electrical contact 90 of the image forming apparatus 1 contacts the electric contact surface 32A of the toner memory 32. Hence, the image forming apparatus 1 can perform at least one of data reading from the toner memory 32 and data writing in the toner memory 32.

At least a part of the holder 33 is covered by the holder cover 34 in a direction from one side to another side in the first direction as illustrated in FIG. 7. The holder cover 34 is positioned at an outer surface of one side in the first direction of the casing 39. The holder 33 includes a first boss 33*a*, a second boss 33*b*, and a third boss 33*c*. The holder 33 has one surface and opposite surface facing the casing 39 in the first direction. The first boss 33*a* extends from the one surface of the holder 33 in the first direction toward the holder cover 34. The second boss 33*b* and the third boss 33*c* extend from the opposite surface of the holder 33 in the first direction toward the casing 39. The second boss 33*b* and the third boss 33*c* are positioned away from each other in the second direction.

The holder cover 34 has a first through-hole 34*a* as illustrated in FIGS. 7 and 8. The first through-hole 34*a* extends throughout a thickness of the holder cover 34 in the first direction. The first boss 33*a* is inserted in the first through-hole 34*a*.

The casing 39 has a second recessed portion 16 and a third recessed portion 17. The second recessed portion 16 and the third recessed portion 17 are recessed toward another side in the first direction of the casing 39 from the outer surface of the one side in the first direction of the casing 39. The second recessed portion 16 and the third recessed portion 17 are away from each other in the second direction. The second boss 33*b* is inserted in the second recessed portion 16. The third boss 33*c* is inserted in the third recessed portion 17. Incidentally, the first through third bosses 33*a*, 33*b*, 33*c* may have cylindrical shape or prismatic columnar shape.

The first through-hole 34*a* has a size (inner dimension) in the second direction greater than a size (external size) of the first boss 33*a* in the second direction. The second recessed portion 16 has a size (inner dimension) in the second direction greater than a size (external size) of the second boss 33*b* in the second direction. The third recessed portion 17 has a size (inner dimension) in the second direction greater than a size (external size) of the third boss 33*c* in the second direction. Hence, the holder 33 is movable together with the first boss 33*a*, the second boss 33*b*, and the third boss 33*c* in the second direction relative to the casing 39 and the holder cover 34. The toner memory 32 having the electric contact surface 32A also moves in the second direction together with the holder 33 in accordance with the movement of the holder 33 in the second direction.

Further, first through-hole 34*a* has a size (inner dimension) in the third direction greater than a size (external size) of the first boss 33*a* in the third direction. The second recessed portion 16 has a size (inner dimension) in the third direction greater than a size (external size) of the second boss 33*b* in the third direction. The third recessed portion 17 has a size (inner dimension) in the third direction greater than a size (external size) of the third boss 33*c* in the third direction. Hence, the holder 33 is movable together with the first boss 33*a*, the second boss 33*b*, and the third boss 33*c* in the third direction relative to the casing 39 and the holder cover 34. The toner memory 32 having the electric contact surface 32A also moves in the third direction together with the holder 33 in accordance with the movement of the holder 33 in the third direction.

Incidentally, number of the boss may be one or two, or not less than four. Further, number of the through-hole of the holder cover 34 may be not less than two. Further, number of the recessed portion of the casing 39 may be one or not less than three. Further, the holder cover 34 may have a recessed portion instead of the first through-hole 34*a*.

As illustrated in FIG. 8, the holder 33 has a first end portion 710 and a second end portion 720. The first end portion 710 is one end portion in the second direction of the holder 33. The second end portion 720 is another end portion in the second direction of the holder 33. The first end portion 710 is movable in the second direction relative to the second end portion 720.

Specifically, the holder 33 includes a first member 331, a second member 332, and a coil spring 333 interposed therebetween. The first member 331 and the second member 332 are made from resin. The first member 331 includes the first end portion 710. The toner memory 32 is fixed to a holding surface included in an outer surface of the first end portion 710. The second member 332 includes the second end portion 720. The first end portion 710 and the second end portion 720 are away from each other in the second direction upon assembly of the holder 33.

The coil spring 333 is a resilient urging member extending in the second direction. The coil spring 333 is positioned between the first end portion 710 and the second end portion 720 in the second direction. The coil spring 333 has one end portion in the second direction connected to the first member 331. The coil spring 333 has another end portion in the second direction connected to the second member 332.

The coil spring 333 is expandable and retractable in the second direction at least between a first state and a second state whose shrinkage is higher than that of the first state. That is, the coil spring 333 has a length in the second direction in the first state greater than the length in the second state. Therefore, a distance between the first end portion 710 and the second end portion 720 in the second direction in the first state is greater than the distance in the second state. Further, the length of the coil spring 333 in at least the second state is shorter than a natural length of the coil spring 333.

Further, as illustrated in FIGS. 7 and 8, a first pawl portion 332*a* and a second pawl portion 332*b* extend from the second member 332. The first pawl portion 332*a* and the second pawl portion 332*b* have pawl tips protruding in a direction crossing the second direction. On the other hand, the first member 331 has a first hole 331*a* and a second hole (not illustrated). The pawl tip of the first pawl portion 332*a* is inserted in the first hole 331*a*. The pawl tip of the second pawl portion 332*b* is inserted in the second hole.

When the coil spring 333 is in the first state, the first pawl portion 332*a* is in contact with the first member 331 at an edge in the second direction of the first hole 331*a*, the edge being closer to the second end portion 720 than another edge in the second direction of the first hole 331*a*. Further, in the first state, the second pawl portion 332*b* is in contact with the first member 331 at an edge in the second direction of the second hole, the edge being closer to the second end portion 720 than another edge in the second direction of the second hole. Such a contact between the edge of the hole and the pawl portion can prevent the length of the coil spring 333 in the second direction from becoming greater than the length in the first state. Further, detachment of the first member 331 from the second member 332 can be obviated. On the other hand, when the coil spring 333 is in the second state, the first pawl portion 332*a* and the second pawl portion 332*b* are moved away from the edges.

Incidentally, instead of the hole, a recessed portion or a stepped portion contactable with the pawl portion is available. Further, the first member 331 may have the pawl portion, and the second member 332 may have the hole or the recessed portion or the stepped portion.

Because of the difference in size between the boss and the through-hole and between the boss and the recessed portion, and expansion and shrinkage of the coil spring 333, the toner memory 32 held by the holder 33 is movable in the second direction relative to the casing 39. Therefore, the contact between the electric contact surface 32A of the toner memory 32 and the main body-electrical contact 90 can be attained at high accuracy even if slight positional displacement between the electric contact surface 32A and the main body-electrical contact 90 occurs when the toner cartridge 30 attached to the drum cartridge 20 is attached to the cartridge holding portion 13.

The electrical contact 35 is fixed to an outer surface of another side in the second direction of the holder 33. That is, the electrical contact 35 is positioned at an outer surface of another side in the second direction of the second member 332 in the second direction. The electrical contact 35 includes four metallic protrusions protruding in the second direction away from the first member 331. The electrical contact 35 is configured to contact the drum-electric contact surface 22A of the drum memory 22 upon attachment of the toner cartridge 30 to the drum cartridge 20.

The wiring 36 connects the electrical contact 35 to the electric contact surface 32A of the toner memory 32. Specifically, the wiring 36 includes four wires. Each of the four wires of the wiring 36 connects each of the four protrusions of the electrical contact 35 to each of the four first electric contact surfaces 32A. When the toner cartridge 30 is attached to the cartridge holding portion 13, each of the four first electric contact surfaces 32A is also connected to each of the four of eight protrusions of the main body-electrical contact 90. Further, each of the four second electric contact surfaces 32A is connected to each of the remaining four of eight protrusions of the main body-electrical contact 90. The four second electric contact surfaces 32A is not connected to the wiring 36. The four second electric contact surfaces 32A are used to transmit information stored in the toner memory 32 to the controller 80 in the main body.

As a result of attachment of the toner cartridge 30 thus constructed to the cartridge holding portion 13 of the housing 10 of the image forming apparatus 1, the electric contact surface 32A of the toner cartridge 30 is brought into contact with the main body-electrical contact 90 of the image forming apparatus 1, and the electrical contact 35 of the toner cartridge 30 is brought into contact with the drum-electric contact surface 22A of the drum cartridge 20.

Hence, information stored in the toner memory 32 is transmitted to the controller 80 through the second electric contact surfaces 32A and the main body-electrical contact 90, and at the same time, the first electric contact surfaces 32A relays information stored in the drum memory 22 to the controller 80. That is, information stored in the drum memory 22 is transmitted to the controller 80 through the electrical contact 35, the wiring 36, the first electric contact surfaces 32A and the main body-electrical contact 90. With such an electrical connection, a compact mechanism for reading information from the toner memory 32 and the drum memory 22 can be provided.

As described above, the toner cartridge 30 according to the present embodiment includes the casing 39, the developing roller 31, the holder 33, the toner memory 32, the electrical contact 35, and the wiring 36. The toner memory 32 includes the electric contact surface 32A positioned at the outer surface of the one side in the second direction of the holder 33. The electrical contact 35 is positioned at the other outer surface of another side in the second direction of the holder 33. The wiring 36 electrically connects the electrical contact 35 to the electric contact surface 32A. The electric contact surface 32A includes the first electric contact surface and the second electric contact surface. The first electric contact surface 32A is electrically connected to the electrical contact 35 through the wiring 36. The second electric contact surface is electrically connected to the toner memory 32.

With this structure, the electric contact surface 32A of the toner cartridge 30 is connectable to the main body-electrical contact 90 of the image forming apparatus 1, and at the same time, the drum-electric contact surface 22A of the drum cartridge 20 is connectable to the electrical contact 35 of the toner cartridge 30. Accordingly, not only information stored in the toner memory 32 of the toner cartridge 30 but also information stored in the drum memory 22 of the drum cartridge 20 can be transmitted to the main body-electrical contact 90 of the image forming apparatus 1.

Further, in the toner cartridge 30 according to the present embodiment, the toner cartridge 30 is attachable to the housing 10 of the image forming apparatus 1. In the attached state of the toner cartridge 30 to the housing 10 of the image forming apparatus 1, the electric contact surface 32A of the toner memory 32 contacts the main body-electrical contact 90 of the image forming apparatus 1. Accordingly, information from the toner memory 32 of the toner cartridge 30 and information from the drum memory 22 of the drum cartridge 20 can be transmitted to the main body-electrical contact 90.

Further, in the toner cartridge 30 according to the present embodiment, in the attached state of the toner cartridge 30 to the housing 10 of the image forming apparatus 1, the electric contact surface 32A of the toner memory 32 contacts the main body-electrical contact 90 of the housing 10 of the image forming apparatus 1. Information stored in the drum memory 22 is transmitted to the first electric contact surface through the electrical contact 35 and the wiring 36. Hence, the information from the drum memory 22 can be transmitted to the main body-electrical contact 90 through the electrical contact 35 the wiring 36 and the electric contact surface 32A.

Further, in the toner cartridge 30 according to the present embodiment, the holder 33 is movable relative to the casing 39. Hence, the drum-electric contact surface 22A and the electrical contact 35 can be contacted with each other at high accuracy, and at the same time, the electric contact surface 32A and the main body-electrical contact 90 can be contacted with each other at high accuracy, even if there is minor positional displacement between the drum-electric contact surface 22A and the electrical contact 35 and between the electric contact surface 32A and the main body-electrical contact 90 when the toner cartridge 30 to which the drum cartridge 20 is attached is attached to the cartridge holding portion 13 of the housing 10.

<3. Modifications>

Various modifications are conceivable. In the above-described embodiment, the drum-electric contact surface 22A is immovable relative to the casing of the drum cartridge 20. However, as a modification, the drum-electric contact surface 22A may be movable relative to the casing of the drum cartridge 20. Similarly, in the above described embodiment, the main body-electrical contact 90 is immovable relative to the housing 10 of the image forming apparatus 1. However, as a modification, the main body-electrical contact 90 may be movable relative to the housing 10.

Further, number of drum-electric contact surface 22A (four in the embodiment) of the drum cartridge 20 may be modified to from one to three, or not less than five.

Further, number of electric contact surface 32A (four in the embodiment) of the toner cartridge 30 may be modified to from one to seven, or not less than nine.

While the description has been made in detail with reference to the embodiment and modifications, it would be apparent to those skilled in the art that various changes and modifications may be made thereto. For example, configuration of each component constituting the image forming apparatus may be different from that illustrated in respective drawings. Further, parts and components appearing in the embodiment and the modifications may be suitably combined together as long as any conflicting structure is avoidable.

What is claimed is:

1. A toner cartridge comprising:

a casing configured to accommodate toner therein;

a developing roller rotatable about a developing axis extending in a first direction;

a holder positioned at an outer surface of one side in the first direction of the casing;

a toner memory storing therein information related to the toner cartridge;

an electric contact surface positioned at an outer surface of one side in a second direction of the holder, the second direction crossing the electric contact surface;

an electrical contact positioned at an outer surface of another side in the second direction of the holder; and a wiring electrically connecting the electrical contact and the electric contact surface, wherein the electric contact surface comprises:

a first electric contact surface electrically connected to the electrical contact through the wiring; and a second electric contact surface electrically connected to the toner memory.

2. The toner cartridge according to claim 1, wherein a drum cartridge includes a drum memory in which information related to the drum cartridge is stored, the drum memory having a drum-electric contact surface, wherein the toner cartridge is attachable to the drum cartridge, and wherein the electrical contact contacts the drum-electric contact surface in a state where the toner cartridge is attached to the drum cartridge.

3. The toner cartridge according to claim 2, wherein the toner cartridge is attachable to a main body of an image forming apparatus, wherein the electric contact surface of the toner memory contacts a main body-electrical contact of the main body in a state where the toner cartridge is attached to the main body, and wherein the information stored in the drum memory is transmitted to the first electric contact surface through the electrical contact and the wiring.

4. The toner cartridge according to claim 1, wherein the toner cartridge is attachable to a main body of an image forming apparatus, and wherein the electric contact surface of the toner memory contacts a main body-electrical contact of the main body in a state where the toner cartridge is attached to the main body.

5. The toner cartridge according to claim 1, wherein the holder comprises a first member and a second member positioned closer to the another side of the holder in the second direction than the first member in the second direction, wherein the electric contact surface is positioned at the first member, and the electrical contact is positioned at the second member, and wherein the first member and the second member are relatively movable in the second direction.

6. The toner cartridge according to claim 5, wherein the holder further comprises a resilient urging member expandable and retractable in the second direction, the resilient urging member having one end portion in the second direction connected to the first member and another end portion in the second direction connected to the second member.

7. The toner cartridge according to claim 6, wherein the resilient urging member is expandable and retractable in the second direction between a first state and a second state, the resilient urging member having a length in the second direction in the first state greater than the length in the second state.

8. The toner cartridge according to claim 7, wherein the resilient urging member is a spring.

9. The toner cartridge according to claim 8, wherein the spring is a coil spring.

10. The toner cartridge according to claim 1, wherein the holder is movable relative to the casing.

11. The toner cartridge according to claim 10, further comprising a holder cover positioned at the outer surface of the one side in the first direction of the casing, the holder cover covering at least a part of the holder, the holder cover having one of a first through-hole and a first recessed portion, wherein the holder has a first boss extending in the first direction and inserted in one of the first through-hole and the first recessed portion, and wherein the first boss is movable in the second direction relative to one of the first through-hole and the first recessed portion in a case where the holder moves in the second direction relative to the casing.

12. The toner cartridge according to claim 11, wherein one of the first through-hole and the first recessed portion has a size in the second direction greater than a size of the first boss in the second direction.

13. The toner cartridge according to claim 11, wherein the outer surface of the one side in the first direction of the casing has a second recessed portion recessed toward another side in the first direction of the casing, wherein the holder further has a second boss positioned opposite to the first boss with respect to the holder and inserted in the second recessed portion, and wherein the second boss is movable in the second direction relative to the second recessed portion in a case where the holder moves in the second direction relative to the casing.

14. The toner cartridge according to claim 13, wherein the second recessed portion has a size in the second direction greater than a size of the second boss in the second direction.

15. The toner cartridge according to claim 1, wherein the toner memory has the electric contact surface.

* * * * *